US006695538B1

(12) United States Patent
Coffey

(10) Patent No.: US 6,695,538 B1
(45) Date of Patent: Feb. 24, 2004

(54) DRAINAGE PIPE SUPPORT/DIVERTER SYSTEM

(76) Inventor: Donald Edward Coffey, 5796 S. Garland Way, Littleton, CO (US) 80127

( * ) Notice: Subject to any disclaimer, the term of this patent is extended or adjusted under 35 U.S.C. 154(b) by 0 days.

(21) Appl. No.: 10/314,789

(22) Filed: Dec. 9, 2002

Related U.S. Application Data

(62) Division of application No. 09/760,965, filed on Jan. 16, 2001, now Pat. No. 6,517,283.

(51) Int. Cl.[7] ..... F16L 1/00; F16L 3/00

(52) U.S. Cl. ..... 405/184.4; 405/43; 405/46; 405/157; 138/105; 248/49; 248/903

(58) Field of Search ..... 405/39, 43, 46, 405/47, 154.1, 157, 159, 172, 184.4; 138/105, 115; 248/49, 65, 903

(56) References Cited

U.S. PATENT DOCUMENTS

| | | | | | |
|---|---|---|---|---|---|
| 1,818,961 | A | * | 8/1931 | Kramer | 248/49 |
| 2,637,170 | A | * | 5/1953 | Benedict | 405/47 |
| 2,803,948 | A | * | 8/1957 | Dorfman | 405/46 |
| 3,212,266 | A | * | 10/1965 | Thompson | 405/47 |
| 3,225,546 | A | * | 12/1965 | Zaucha | 405/47 |
| 4,069,684 | A | * | 1/1978 | Wilson | 405/157 |
| 4,163,619 | A | * | 8/1979 | Fales | 405/49 |
| 4,268,189 | A | * | 5/1981 | Good | 405/184.4 |
| 5,549,415 | A | * | 8/1996 | Evans | 405/43 |
| 5,871,306 | A | * | 2/1999 | Tilcox | 405/157 |
| 5,971,663 | A | * | 10/1999 | Brothers | 405/125 |
| 6,120,209 | A | * | 9/2000 | Evans | 405/43 |
| 6,336,770 | B1 | * | 1/2002 | Evans | 405/43 |
| 6,517,283 | B2 | * | 2/2003 | Coffey | 405/43 |

FOREIGN PATENT DOCUMENTS

| | | | | |
|---|---|---|---|---|
| CH | 672673 | * | 12/1989 | 248/49 |
| WO | 9404861 | * | 3/1994 | 248/49 |

* cited by examiner

*Primary Examiner*—Jong-Suk (James) Lee
(74) *Attorney, Agent, or Firm*—Quinn & Quinn, P.C.; William J. Quinn; Cornelius P. Quinn

(57) ABSTRACT

A drainage support/diverter system for use in connection with a perforated pipe drainage system within a drainage trench, comprising a number of drainage support/diverters that create impermeable barriers to moisture flow along the length of the trench outside the perforated pipe, such drainage support/diverters are positioned upon intervals along the drainage trench with their lower ends placed to a depth at least as deep as lowest depth of the drainage trench where each drainage support/diverter is placed, extend laterally at least as wide as the widest point of the drainage trench where each drainage support/diverter is placed and are formed at their upper ends with a recess corresponding to a portion of the diameter of the perforated pipe such that moisture outside the perforated pipe is forced to enter the perforated pipe at the point of each drainage support/diverter.

2 Claims, 4 Drawing Sheets

DRAINAGE PIPE SUPPORT/DIVERTER SYSTEM

CROSS REFERENCE TO RELATED APPLICATION

This application claims the benefit of, and is a divisional application of U.S. utility patent application Ser. No. 09/760,965 filed on Jan. 16, 2001, now U.S. Pat. No. 6,517,283 which is entitled.

FIELD OF THE INVENTION

The present invention relates generally to drainage means and drainage systems employed therefore, and more particularly to a novel drainage system construction incorporating cascading chutes which create an inner channel from which collected fluid cannot escape to re-infiltrate surrounding soil prior to its discharge point.

BACKGROUND OF THE INVENTION

Where it is indicated by the terrain, soil structure, climate, landscaping or construction activities, it is often desirable or necessary to provide a drainage means for collecting and relocating moisture accumulating on the surface and moisture saturating the ground. By controlling the accumulation of surface moisture and moisture saturation of the ground, undesirable erosion, settling, and soil expansion are reduced. Such drainage means are often utilized surrounding and underneath buildings, rights of way such as highways, golf courses, athletic fields, recreational areas and similar applications.

A variety of drainage means suitable for use in collecting of surface moisture and moisture saturation of the ground are well known in the prior art, however, none have been entirely effective.

A predominant drainage means of the prior art is the use of so-called french drain systems. In constructing a french drain system, one or more trenches are dug in the ground with the trench or trenches sloping downward toward a collection point. Perforated pipe is then laid with fall sloping toward the discharge point, within a bed of gravel in the trench. Turf, landscaping, or construction structures may then be placed upon or around the gravel filled trench. In such a drain system, water is supposed to enter the pipe through the perforations and flow through the pipe by gravitational force to an outlet or pump at the discharge point; however, in operation, often times the water flows toward the discharge point within the gravel outside the pipe; this water, flowing within the gravel outside the pipe toward the collection point, re-infiltrates the soil at less saturated intermediate points. Additionally, as a result of the design of the system, water within the pipe cannot be contained within the pipe, and in operation, collected water within the pipe often exits the pipe and re-infiltrates the soil at less saturated intermediate points toward the discharge point. As a result of this re-infiltration of water, soil stability along the length of the drain system is not maintained and the soil continues to expand and contract from variations in moisture saturation. Additionally, the flow of water toward the discharge point within the gravel outside of the pipe, results in deterioration of the trench.

A typical modified form of a french drain system incorporates the use of permeable material, such as landscape fabric, to shield the gravel and pipe from silt and fine sediment which tend to accumulate in the pipe and gravel, gradually diminishing the effectiveness of the system.

However, in application, the permeable material often becomes congested with the silt and fine sediment resulting in an increase in the effective hydrostatic pressure of the surrounding soil. Also, impermeable material has been applied to the bottom surface of the trench, below the perforated pipe, to protect it from the deteriorating effect of water flowing through the gravel outside of the pipe. However, the application of such impermeable material to the bottom of the trench has the undesirable effect of creating a barrier which prevents drainage of moisture from below the impermeable material which would otherwise percolate upwards. U.S. Pat. Nos. Re. 20,736 and 2,135,103 to Dimrick, which may be placed in a gravel filled trench, disclose a drainage pipe with inclined upper trough sections which empty into a lower pipe cavity at the termination of each trough section. Water is meant to be caught by the trough sections on the upper surface and emptied into the lower pipe cavity. With the drainage pipe according to Dimrick, it is apparent that silt and sediment that wash down through the gravel will quickly accumulate in the upper trough section and lower pipe cavity; further as water is collected by the Dimrick device at its upper surface, unless the water falls directly into the trough, sufficient hydrostatic pressure must accumulate for the water level to reach the top of the pipe before the water is collected. Additionally, the Dimrick device does not prevent the flow of water through the gravel toward the discharge point outside of the upper trough or lower cavity.

U.S. Pat. No. 2,663,997 to Schmidt et al. discloses a drainage tube, which may be set in a gravel filled trench, having inlet passageways that are protected by an overhanging cover. Although the Schmidt device is designed to alleviate the accumulation of silt and sediment by requiring that water must rise to enter the drainage tube, its very design necessitates the undesirable result that sufficient hydrostatic pressure be present to cause the water level to rise to the height of the inlet passageways. Additionally, the Schmidt et al. device does not prevent water flowing through the gravel toward the discharge point outside the tube.

As a final illustrative example of drainage means of the prior art that is suitable for use in a gravel filled trench, U.S. Pat. No. 4,389,138 to Soderstrom discloses a drainage system having a pipe that is divided into a central channel and two peripheral channels. The central channel is open at its lowermost end and the peripheral channels are closed at their lowermost end. The central channel is separated from each peripheral channel by a partition wall having openings in their uppermost ends. Additionally, the use of plugs at intervals along the central channel to create barriers to flow along the central channel to the discharge point is disclosed. Although the Soderstrom device prevents water from flowing to the discharge point through the gravel outside the pipe, excess hydrostatic pressure is necessary in operation of the device as the water level must rise to the level of the openings in the partition wall.

Accordingly, it is an object of the present invention to provide an improved drainage means, for collecting and relocating moisture accumulating on the surface and moisture saturating the ground, which does not require excess hydrostatic pressure in operation, isolates the water collected from re-infiltration and does not possess the shortcomings of the prior art drainage devices.

An additional objective of the present invention is to provide an improved drainage means that may be constructed from low cost and readily available construction materials.

SUMMARY OF THE INVENTION

The objects of the present invention are obtained by a drainage system construction incorporating cascading chutes, which collect moisture at their leading ends and form an inner channel from which the collected moisture cannot escape to re-infiltrate soil surrounding the drainage system prior to reaching the discharge point of the drainage system.

Although the present invention is hereinafter being described with reference to its application within a prepared trench, it should be apparent that the invention is suitable for use in other applications, such as surface applications where there is sufficient slope.

Within a prepared trench with sufficient fall, a series of concave chutes are fixed in overlapping alignment. The bottom of the trench should have a fall equal to or greater than ¼ inch per foot. The concave chutes are fixed with their leading end upon the surface or base of the trench and their trailing end elevated so that the elevation rate of each concave chute is ⅛ of an inch per foot or more and creating an effective fall within each chute of ⅛ per foot or more. The concave chutes may be fabricated by cutting a semicircular section from commercially available pipe of plastic, metal or other suitable material; or preferably the concave chutes may be fabricated from sheet stock of plastic, metal or other suitable material which is then bent and fixed into the necessary concave shape. The concave chutes are preferably tapered toward their leading edge so as to facilitate the collection of moisture. If desired, the drainage system may be concealed and allow overlying landscaping or construction by filling the trench containing the concave chutes with gravel.

In operation of the drainage system of the present invention moisture from the surface and surrounding soil, under force of gravity or hydrostatic pressure, enters the trench where it flows toward the overlapping concave chutes. At the leading edge of each concave chute any moisture present is collected and flows within the concave chute by gravitational force in a direction toward the trailing edge of the concave chute. Although the amount of fall within each chute is slightly less than that of the bottom surface of the trench, it has been found that there is less resistance to moisture flow within the concave chutes in comparison to that outside of the concave chute within the trench; therefore moisture within the trench, seeking the path of least resistance, is readily collected into the concave chutes rather than flowing along the trench outside the concave chutes. Upon reaching the trailing edge of a concave chute, moisture flowing within the concave chute falls within a successive concave chute and continues flowing toward the trailing edge of each successive concave chute. As the trailing edge of each concave chute overlaps the leading edge of its successive concave chute, moisture collected at the leading edge of any concave chute is isolated and prevented from re-infiltrating the soil surrounding successive concave chutes.

As an enhancement of the present invention, the concave chutes may be enclosed within a perforated pipe, to protect the concave chutes from the accumulation of silt and sediment, and to provide structural protection to prevent damage to the concave chutes. The pipe stock utilized may be any commercially available pipe of plastic, metal or other suitable material of appropriate diameter. The pipe utilized is fashioned with an opening or perforations along the lower surface of its diameter to allow the entry of moisture. Additionally, when pipe of appropriate diameter is utilized, the pipe further serves to maintain the concavity of concave chutes fashioned from resilient material.

As an additional enhancement of the present invention, a catch basin may be provided to assist in collecting moisture into the concave chutes. The catch basin extends outward laterally from both sides of the concave chutes to catch moisture from the surrounding soil and surface above and direct it toward the concave chutes. The catch basin is placed below the concave chutes and is fashioned with support tabs which emanate from directly below the concave chutes and are attached to the concave chutes maintaining the concavity and elevation of the concave chutes. Further, an oversized aperture is fashioned in the catch basin at the leading edge of each concave chute, through which a tab fashioned upon the leading edge of the concave chute passes; in addition to mechanically fixing the leading edge of the concave chute, this oversized aperture allows percolating moisture from below the catch basin to be collected into the concave chute.

A final enhancement of the present invention is the incorporation of drain support/diverters at intervals along the length of the drain system. Each drain support/diverter, is driven into the base of the trench and supports the protective perforated pipe. These drain support diverters are fashioned of plastic, metal or other suitable material, have a semi-circular recesses formed in their upper ends and are designed to span the width of the trench. As each drain support/diverter is driven into the base of the trench and spans the width of the trench, moisture unable to traverse the drain support/diverter is forced into collection by the concave chutes and prevented from flowing toward the discharge point within the trench outside of the concave chutes.

While these drain support/diverters are utilized to capitalize upon the isolating effect of the present cascading chute drainage system, they are also suitable for use in connection with other perforated pipe drainage systems, such as the french drain systems hereinbefore described, to force water flowing along the perforated pipe to enter the pipe at intervals along its length.

Other objects, advantages and novel features of the present invention will become apparent from the following drawings and detailed description of the preferred embodiments.

DETAILED DESCRIPTION OF THE PREFERRED EMBODIMENT

Figure 1:
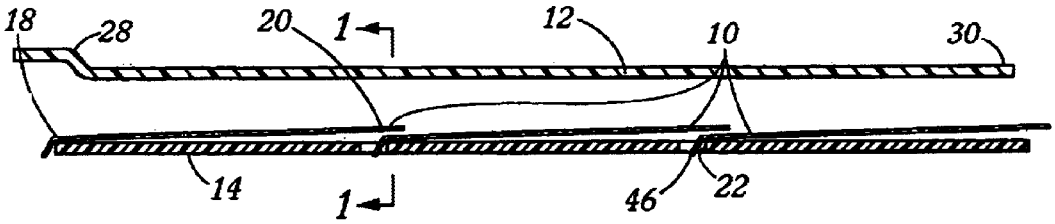
FIG. 1 is a longitudinal section view of a preferred embodiment of the drainage system of the present invention.
Figure 2:
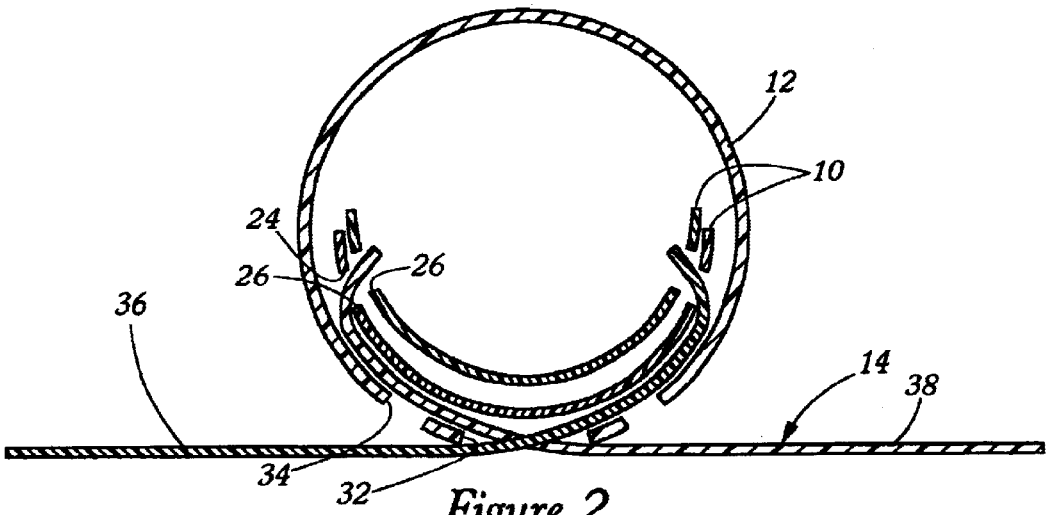
FIG. 2. is a transverse section view of the preferred embodiment of the drainage system depicted in FIG. 1 taken along the line 1—1.
Figure 3:
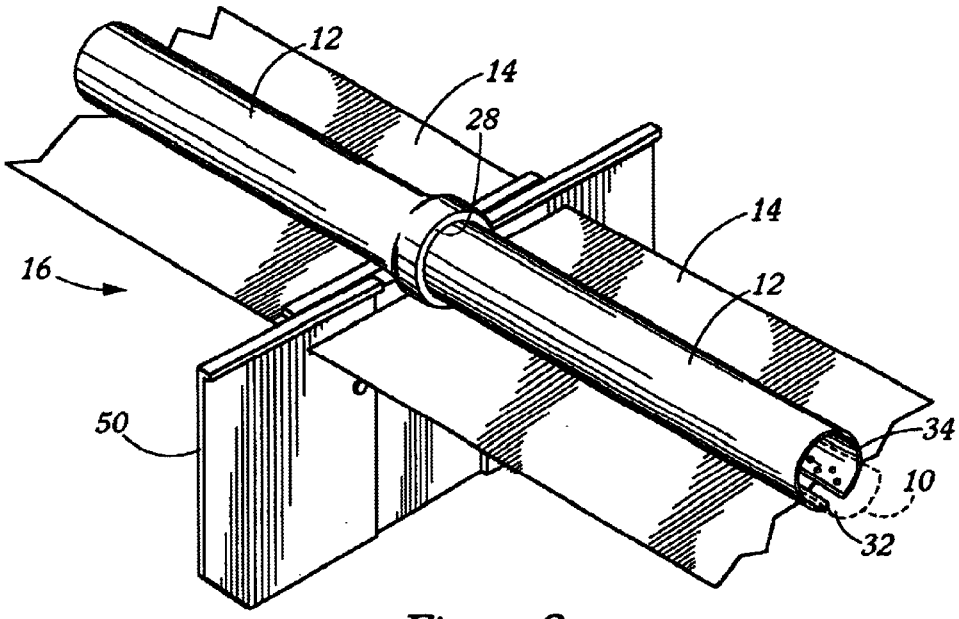
FIG. 3. is a perspective view of the preferred embodiment depicted in FIGS. 1 and 2.

Referring to FIGS. 1 through 3, a preferred embodiment of the drainage system of the present invention is hereinafter illustrated.

The drainage system comprises a series of concave chutes 10, a protective perforated pipe 12, a catch basin 14 and a number of drain support/diverters 16. The concave chutes, each having a leading end 18 and a trailing end 20 are arranged in succeeding fashion such that the trailing end 20 of a concave chute is elevated above and overlaps the leading end 18 of its successive concave chute 10.

Each concave chute 10 may be attached at its leading end 18 through an oversized aperture 22 fabricated in catch basin 14. Catch basin 14 is further fabricated with support tabs 24 which engage slots 26 of concave chute 10 to maintain the concavity and elevation of concave chutes 10.

A protective perforated pipe 12 encloses concave chutes 10 to prevent damage from mechanical forces and to deter congestion of the concave chutes 10 from accumulation of silt and sediment. Further, the inner surface of protective. perforated pipe 12 serves to provide support to the concave chutes 10 and maintain their concavity. The protective perforated pipe is fashioned from suitable pipe stock, commonly of four inch diameter and ten foot lengths with a bell end 28 and a spigot end 30. The protective perforated pipe 12 is positioned at its bell end 28 by a drain support diverter 16. A slot 32 is cut along the longitudinal length of the lowermost section of the diameter of the protective perforated pipe 12; and perforation openings 34 are fabricated along the length of protective perforated pipe 12 on both sides of and adjacent to slot 32.

The protective perforated pipe 12 is assembled around concave chutes 10 by aligning slot 32 with the base end of support tabs 24 of catch basin 14 and sliding perforated pipe 12 over concave chute 10 with the base end of support tabs 24 traversing slot 32. When assembled, the protective perforated pipe 12 is arranged with the bell end 28 upstream with the leading end 18 of concave chutes 10 and the spigot end 30 downstream with trailing end 20 of concave chute 10.

It can be readily ascertained that a continuous drainage system of this preferred embodiment may be constructed from a series of 10 foot lengths of assembled concave chutes 10 protective perforated pipe 12 and catch basin 14. Shorter segments may be fashioned by cutting such assemblies at the spigot end 30 of protective perforated pipe 12. Further commercially available standard pipe and fittings may be connected to such assemblies to fabricate particular drainage system layouts and to carry collected moisture through areas where drainage of moisture is not necessary or desired.

Figure 4:
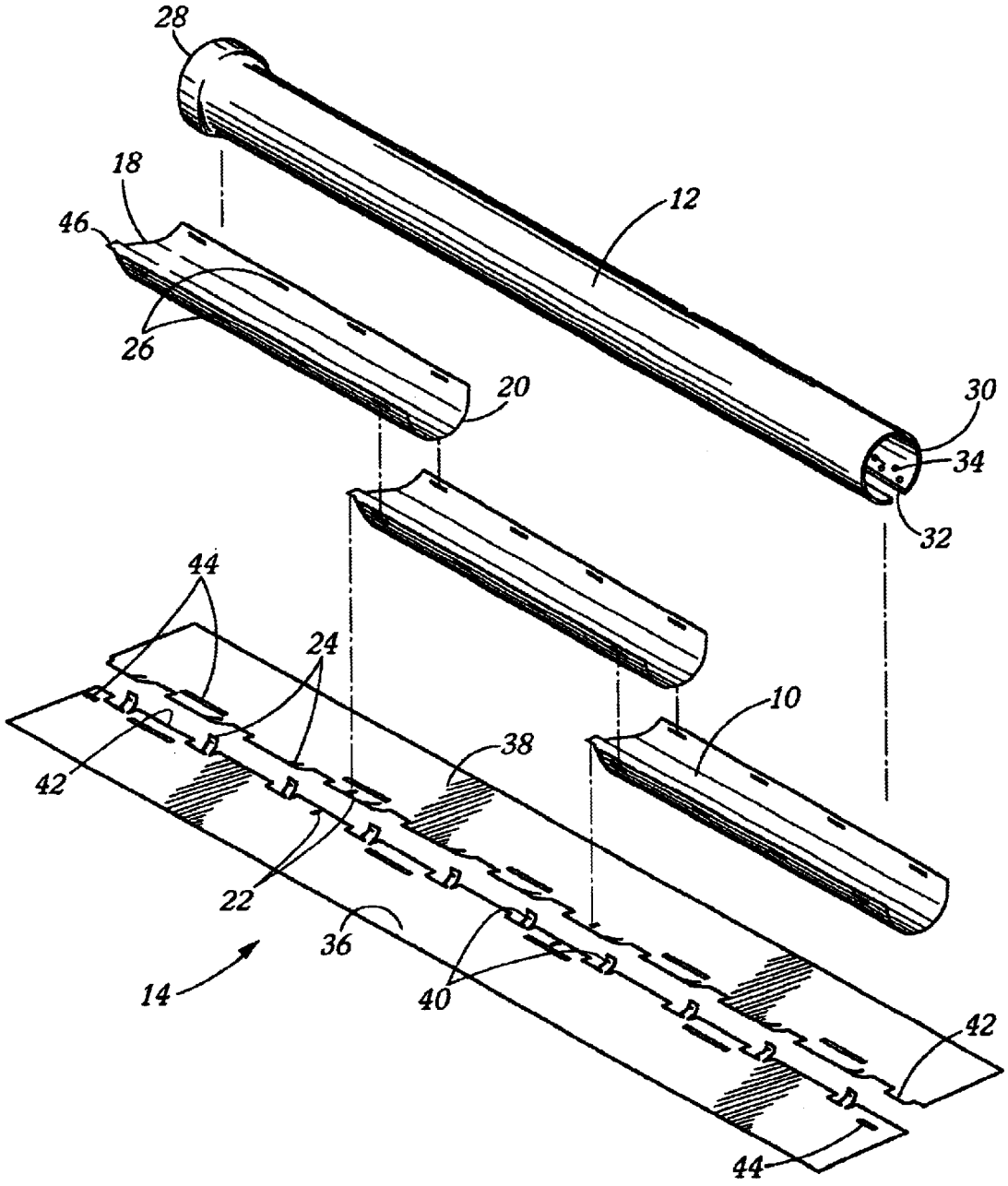
FIG. 4. is an exploded view of the concave chutes, catch basin assembly, and perforated pipe of the preferred embodiment depicted in FIGS. 1 through 3.
Figure 5:
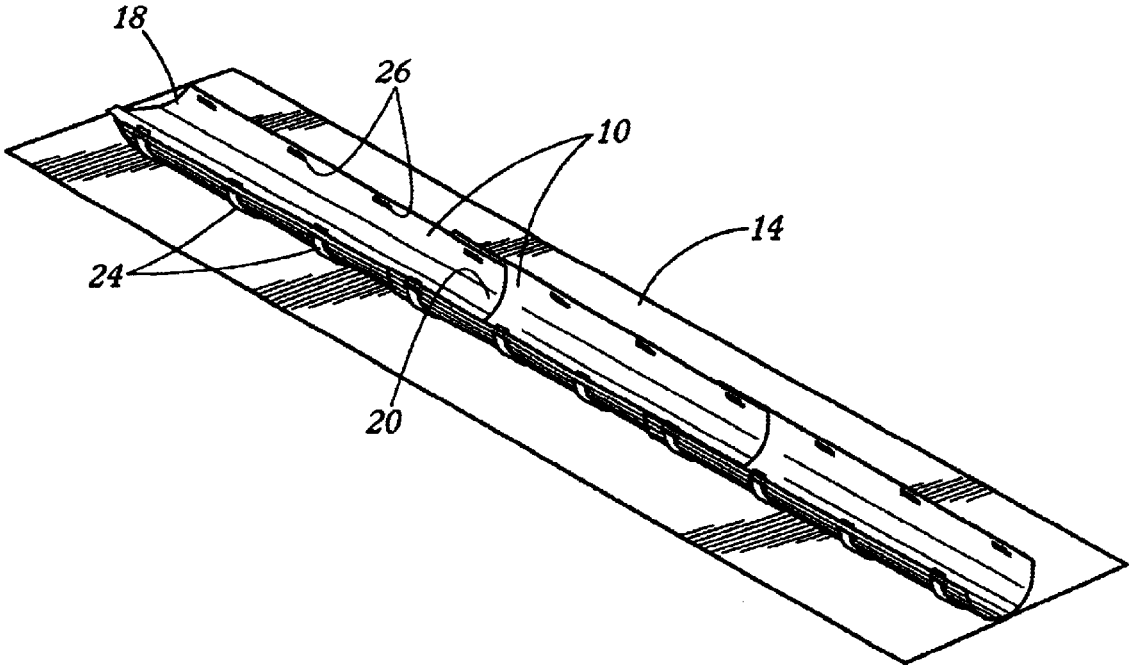
FIG. 5. is a perspective view of the concave chutes and catch basin assembly of FIG. 4 in assembled fashion.

Referring to FIGS. 4 and 5, illustrating details of concave chutes 10 and catch basin 14 of the preferred embodiment, catch basin 14 may be fashioned from complimentary left basin sections 36 and right basin sections 38. The left basin section 36 and right basin section are cut or stamped with alignment slots 40 designed to engage corresponding alignment slots 40 in the complementary basin section; also securing tabs 42 which engage securing slots 44 on the complimentary basin section are provided.

Each concave chutes 10 is fabricated with a taper toward its leading end 18 and an attachment tab 46 at its leading end 18 to engage oversized aperture 22. the slots 26 of each concave chute 10 further engage support tabs 24 of catch basin 16.

Because of the design of the complimentary left basin sections 36, right basin sections 38 and concave chutes 10, as illustrated in FIG. 4, the preferred embodiment provides integrated opposing interlocking components. Therefore, no additional fasteners are necessary to assemble a self-sustaining structure.

Figure 6:
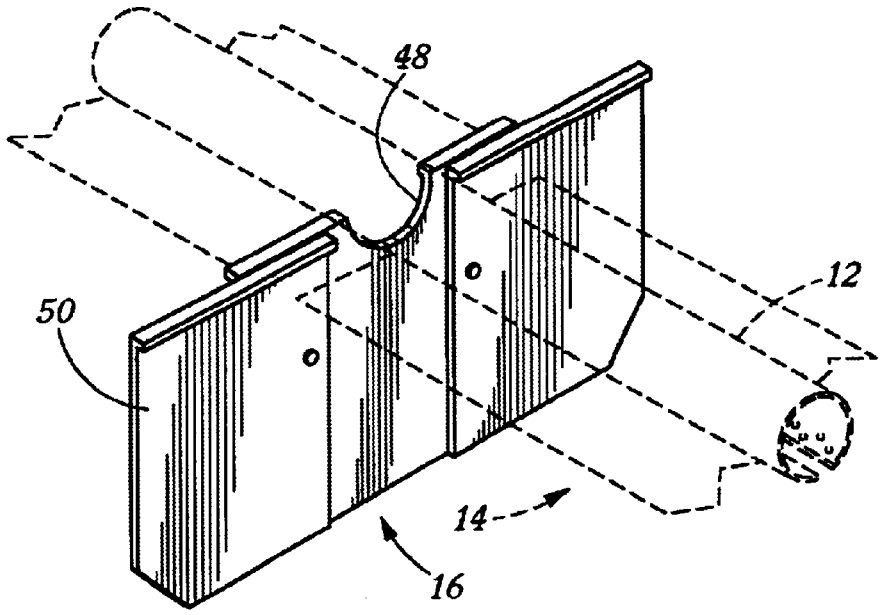
FIG. 6. is a perspective view of an embodiment of a drain support/diverter suitable for use in the preferred embodiment depicted in FIGS. 1 through 4.

Referring to FIG. 6, an embodiment of a drain support/diverter 16 suitable for use with the preferred embodiment of the present invention or other perforated pipe drainage system is illustrated. The drain support diverter 16, is preferably driven about 8 inches into the soil, and is fashioned with a semi-circular recess 48 at its upper end, corresponding to the radius of and for receiving protective perforated pipe 14. Extension panels 50 are provided which are secured to drain support diverter 16 and are extended to create a barrier for moisture to flow around the protective perforated pipe 14.

Figure 7:
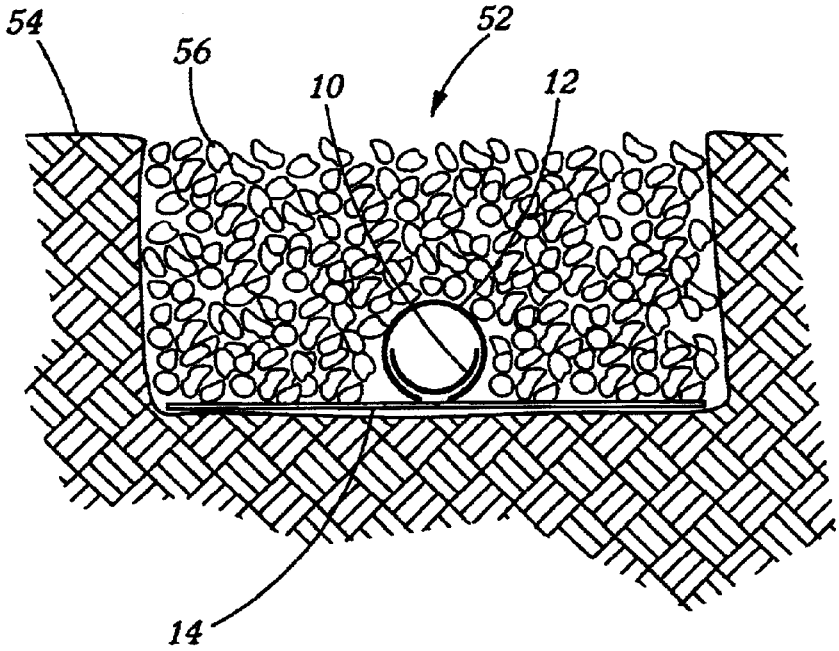
FIG. 7. is a transverse section view of a prepared trench having the preferred embodiment depicted in FIGS. 1 through 4 installed therein.

Referring to FIG. 7, the preferred embodiment of the drainage system of the present invention is installed within a trench 52 cut below ground surface 54. The bottom of trench 52 is constructed with sufficient fall for the operation of the drainage system, and may be the width of or wider than the catch basin 16. Gravel 56 or other suitable material is filled into the trench 52 to promote any moisture entering the trench to be rapidly collected and relocated by the drainage system.

Although the detailed description of the drawings is directed toward illustrating the above described preferred embodiment, the present invention is not limited to such embodiment, as variation and modification may be made without departing from the scope of the present invention as claimed herein.

What is claimed is:

1. A drainage support/diverter system for use within a drainage trench containing perforated pipe comprising, a number of drainage support/diverters, of solid and substantially flat structure, that are positioned upon intervals along said drainage trench, each said drainage support/diverter extending laterally at least as wide as said trench, placed to a depth at least as deep as the bottom surface of said trench and being formed with a recess extending below the uppermost surface of said drainage support/diverter and corresponding to at least a portion of the diameter of said perforated pipe, wherein moisture flowing outside said perforated pipe is directed into said perforated pipe before rising to the level of the uppermost surface of said drainage support/diverter.

2. A drainage support/diverter system for use within a drainage trench containing perforated pipe comprising, a number of drainage support/diverters that are positioned upon intervals along said drainage trench, said drainage support/diverters having extension panels that are laterally extendable to accommodate various trench widths, said drainage support/diverters extending laterally at least as wide as said trench, placed to a depth at least as deep as the bottom surface of said trench and being formed with a recess corresponding to at least a portion of the diameter of said perforated pipe, wherein moisture flowing outside said perforated pipe is directed into said perforated pipe.

* * * * *

UNITED STATES PATENT AND TRADEMARK OFFICE

CERTIFICATE OF CORRECTION

PATENT NO. : 6,695,538 B1
DATED : February 24, 2004
INVENTOR(S) : Donald Edward Coffey It is certified that error appears in the above-identified patent and that said Letters Patent is hereby corrected as shown below:

Column 1,
Line 10, after the word "entitled" insert -- Cascading Chute Drainage System --

Signed and Sealed this

Fifteenth Day of June, 2004

JON W. DUDAS
*Acting Director of the United States Patent and Trademark Office*